US010450037B2

(12) United States Patent
Boozer et al.

(10) Patent No.: US 10,450,037 B2
(45) Date of Patent: Oct. 22, 2019

(54) MARINE TOWER ADJUSTABLE ATTACHMENT SYSTEM

(71) Applicant: RTM, LLC, Columbia, SC (US)

(72) Inventors: Chad Haskell Boozer, Irmo, SC (US); Edward Forbes, Hilton Head Island, SC (US); Henry Bradley Huff, Jr., Pomaria, SC (US)

(73) Assignee: RTM, LLC, Columbia, SC (US)

( * ) Notice: Subject to any disclaimer, the term of this patent is extended or adjusted under 35 U.S.C. 154(b) by 0 days.

(21) Appl. No.: 15/935,311

(22) Filed: Mar. 26, 2018

(65) Prior Publication Data

US 2019/0291822 A1 Sep. 26, 2019

(51) Int. Cl.
*B63B 17/02* (2006.01)

(52) U.S. Cl.
CPC ..... *B63B 17/02* (2013.01)

(58) Field of Classification Search
CPC ..... B63B 17/02; B63B 17/00
See application file for complete search history.

(56) References Cited

U.S. PATENT DOCUMENTS 8,424,643 B1 * 4/2013 Speaks ..... B63B 17/00 182/180.3
2009/0320738 A1 * 12/2009 Blumberg ..... B63B 17/00 114/364
2018/0163468 A1 * 6/2018 Mora ..... E06C 7/083

* cited by examiner

*Primary Examiner* — Stephen P Avila
(74) *Attorney, Agent, or Firm* — Thrive IP; Bernard Klosowski

(57) ABSTRACT

A universal boat tower system includes an adjustment system having raceways formed in tower uprights and crossbars for receiving extensions from adapters to affix the adapters and the tower system to boat consoles and other equipment.

18 Claims, 11 Drawing Sheets

MARINE TOWER ADJUSTABLE ATTACHMENT SYSTEM

BACKGROUND OF THE DISCLOSURE

Many boats have towers or superstructures over which covers or tops are attached and under which consoles or other equipment are installed. Usually a console is connected to the legs or frames of a tower for stability. More particularly, the tower frames are bolted or welded to the console.

A significant problem with existing connections between tower frames and nearby equipment is that different towers must be constructed for different boat styles, equipment designs, and stand-off distances.

What is needed in the boating industry is a tower system with universal, adjustable attachments that do not require permanent connections between tower frames and nearby equipment so that the universal tower system can be used with a variety of boats.

BRIEF SUMMARY OF THE DISCLOSURE

The present disclosure is directed in general to universally attachable boat top conning towers. The exemplary attachment systems may include grooves, tracks, or raceways formed in conning tower frames in which connectable adapters are adjustable or positionable to attach the frames to nearby equipment such as a center instrument console.

Unless defined otherwise, all technical and scientific terms used herein have the same meaning as is commonly understood by one of ordinary skill in the art to which this disclosure belongs. In the event of multiple definitions for a term used herein, definitions in this section prevail unless stated otherwise.

Wherever the phrase "for example," "such as," "including" and the like are used herein, the phrase "and without limitation" is understood to follow unless explicitly stated otherwise. Similarly, "an example," "exemplary" and the like are understood to be non-limiting.

The term "substantially" allows for deviations from the descriptor that do not negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etcetera. Thus, for example, "a device having components a, b, and c" means that the device includes at least components a, b and c. Similarly, the phrase: "a method involving steps a, b, and c" means that the method includes at least steps a, b, and c.

Unless the context clearly requires otherwise, throughout the description and the claims, the words "comprise", "comprising", and the like are to be construed in an inclusive sense as opposed to an exclusive or exhaustive sense; in the sense of "including, but not limited to".

While terms such as "first," "second," "third," and "fourth" are used to identify various components of various embodiments, unless otherwise stated in the context in which those terms are utilized, such terms are simply an arbitrary naming convention to distinguish between pieces and parts. For instance, a "first part" and a "second part" are not limited relative to each other in importance or chronologically. The "first part" could be called the "second part" and vice versa unless expressly stated otherwise herein.

Any discussion of background material in the specification should in no way be considered as an admission that it is known prior art or forms part of common general knowledge in the field.

The various embodiments of the disclosure and/or equivalents falling within the scope of present disclosure overcome or ameliorate at least one of the disadvantages of the prior art, or provide a useful alternative.

One tower adjustment system for boats according to the disclosure may include an upright for holding a boat top, the upright having a first raceway formed therein; a cross bar connected to the upright, the cross bar having a second raceway formed therein; and an adapter movable along at least one of the first and second raceways, the adapter being attachable to a control console and securable in the raceway to render the upright stationary relative to the console. The cross bar may be D-shaped in cross-section and may be made from extruded aluminum or other metal. In this embodiment, the adapter may be L-shaped, and the connector may have a head slidable in the raceways and connected to the adapter.

The tower adjustment system may also include an extension assembly movably connected to the adapter, the extension assembly being configured to bridge a gap between the control console and the upright. The tower adjustment system may include at least two adapters and at least two uprights disposed apart from each other and substantially parallel to each other for holding the boat top. Also in this embodiment, the upright or the cross bar may include a third raceway formed therein for receiving equipment or for receiving an additional adapter for connecting to boat equipment proximate the upright or the cross bar.

In another embodiment according to the disclosure, a tower adjustment system for boats may include at least two uprights disposed in parallel and apart from each other for holding a boat top, each upright having a substantially vertically oriented raceway formed therein; a respective cross bar connected to each of the uprights, the cross bars each having a substantially horizontally oriented raceway formed therein; and a plurality of adapters movable along the raceways, the adapters being attachable to a plurality of boat equipment proximate the uprights and securable in the raceways to render the uprights stationary relative to the boat equipment. The cross bar may be D-shaped in cross-section and may also have scallop-shaped indentations. Still further, the cross bar may be extruded aluminum, and the adapter may be L-shaped.

The tower adjustment system in this embodiment may also include a connector having a head slidable within the raceways and a body depending from the head connectable to the adapter. The tower adjustment system may further include an extension assembly movably connected to the adapter, the extension assembly being configured to bridge a gap between one of the boat equipment and the upright. The boat equipment may include a center console.

Also in this embodiment, at least one of the uprights or the cross bar has may have two or more raceways formed therein for receiving an additional adapter for connection to the boat equipment. Alternatively, at least one of the uprights or the cross bar may have a second raceway disposed apart from the first raceway for receiving equipment.

Other embodiments include the foregoing and other elements and steps described herein, and their equivalents, in various combinations.

Additional objects and advantages of the present subject matter are set forth in, or will be apparent to, those of ordinary skill in the art from the description herein. Also, it should be further appreciated that modifications and variations to the specifically illustrated, referenced, and discussed features, processes, and elements hereof may be practiced in various embodiments and uses of the disclosure without departing from the spirit and scope of the subject matter. Variations may include, but are not limited to, substitution of equivalent means, features, or steps for those illustrated, referenced, or discussed, and the functional, operational, or positional reversal of various parts, features, steps, or the like. Those of ordinary skill in the art will better appreciate the features and aspects of the various embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification that refers to the appended figures in which.

DETAILED DESCRIPTION OF THE DISCLOSURE

Figure 1:
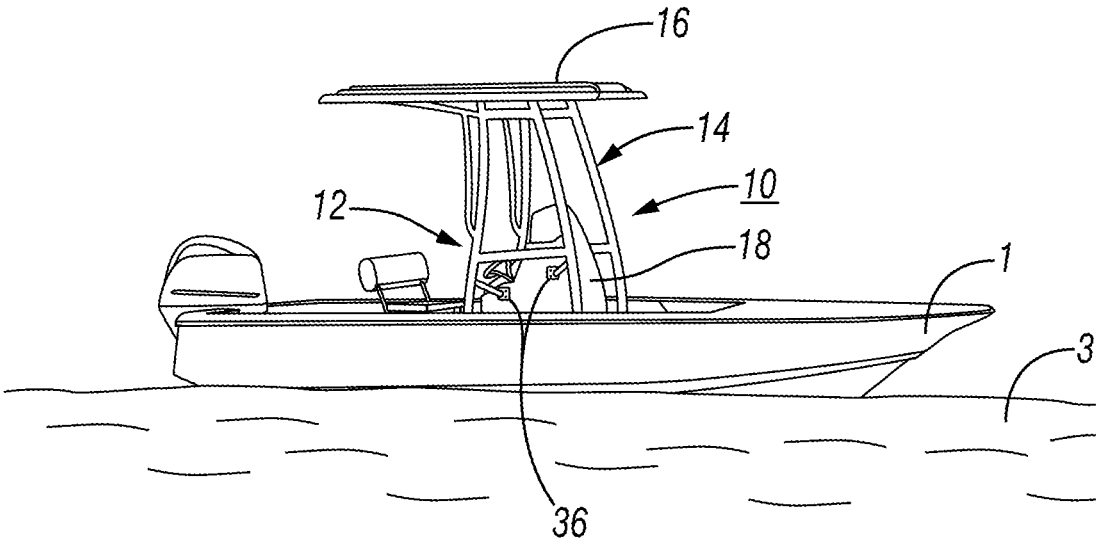
FIG. 1 is a perspective view of an embodiment in an intended use environment according to one aspect of the disclosure.

Detailed reference will now be made to the drawings in which examples embodying the present subject matter are shown. The detailed description uses numerical and letter designations to refer to features of the drawings. The drawings and detailed description provide a full and written description of the present subject matter, and of the manner and process of making and using various exemplary embodiments, to enable one skilled in the pertinent art to make and use them, as well as the best mode of carrying out the exemplary embodiments. The drawings are not necessarily to scale, and some features may be exaggerated to show details of particular components. Thus, the examples set forth in the drawings and detailed descriptions are provided by way of explanation only and are not meant as limitations of the disclosure. The present subject matter thus includes any modifications and variations of the following examples as come within the scope of the appended claims and their equivalents.

Turning now to the figures, FIG. 1 shows a watercraft, vessel or boat designated by reference numeral 1. Here, the boat 1 is afloat on a body of water 3 and is equipped with a boat top tower system broadly designated by the reference numeral 10. The boat top system 10 may be installed during manufacture of the boat 1 or in the aftermarket.

More particularly, FIG. 1 shows that the boat top system or tower 10 may include a top, cover or cap 16 elevated by starboard and port, i.e., right and left, frames 12, 14. In this example, although there are two frames 12, 14 each having curvilinear features with various openings, the disclosure is not limited to this exemplary superstructure. Also shown in FIG. 1, a control or pilot station or center console 18 is positioned between the frames 12, 14. To provide structural integrity and stability, the frames 12, 14 may be attached to the console 18 or to other nearby equipment using connectors or adapters 36 that are adjustable relative to the frames 12, 14, as described in more detail below.

Figure 2:
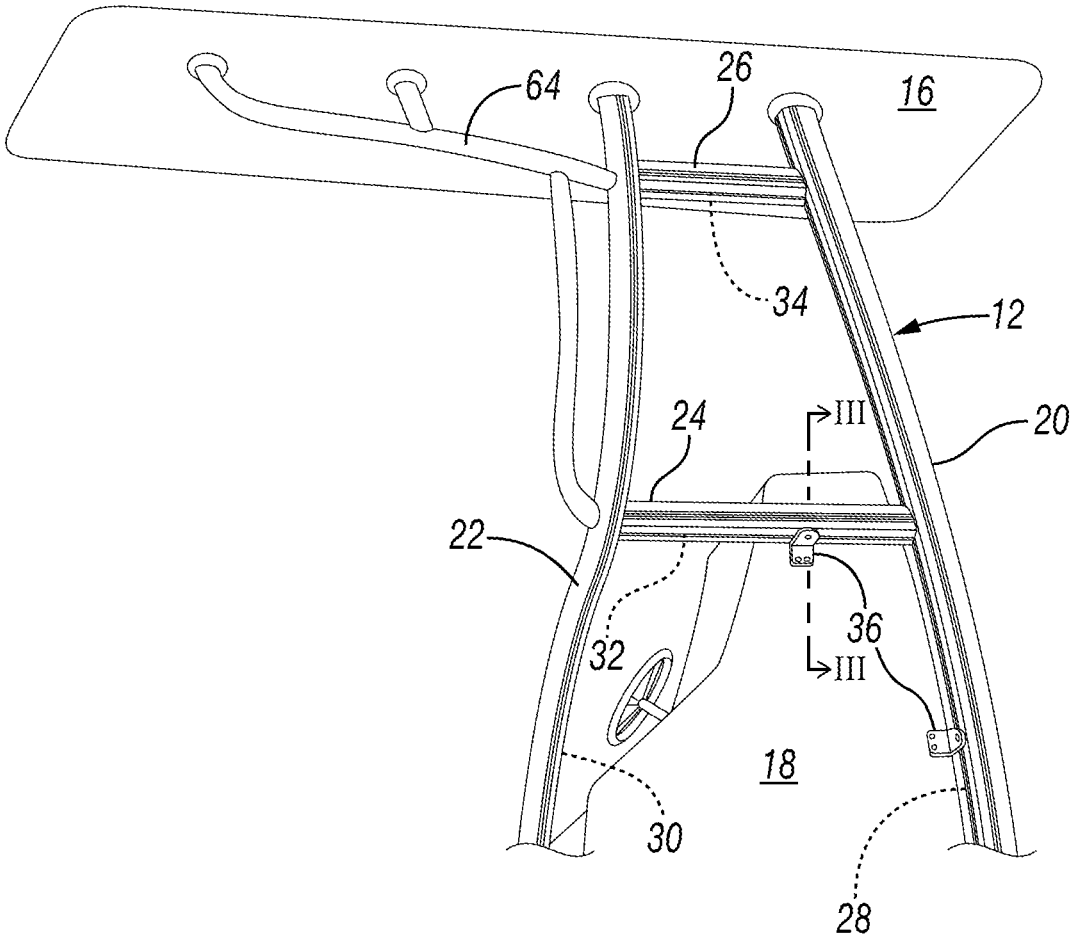
FIG. 2 is a partial perspective view of some components utilized in the embodiment shown in FIG. 1.

Turning to FIG. 2, the right frame 12 is shown by way of example in connection with the console 18. As shown, the right frame 12 may include a forward or first leg or upright 20 and an aft or second leg or upright 22. In this example, the uprights 20, 22 are spaced apart or separated from each other by a lower or bottom crossbar or beam 24 and an upper or top crossbar or beam 26, although fewer or additional beams may be utilized as necessary. Here, the uprights 20, 22 have respective raceways, tracks, channels, or grooves 28, 30, and the crossbars 24, 26 may include respective raceways, tracks, channels or grooves 32, 34. Although the raceways 28, 30, 32, 34 are shown in this exemplary embodiment running most or the entire length of their respective host components, the raceways 28, 30, 32, 34 can be formed only in substantially flat areas of the exemplary curvilinear uprights 20, 22, or in limited areas of the crossbars 24, 26. Here, the uprights 20, 22 and the crossbars 24, 26 can be made from 6063-type "D" shaped extruded aluminum, which provides suitable structural strength for shaping with the channels 32, 34. By way of example, during or after extrusion of the uprights 20, 22 with their respective channels 32, 34 formed therein, the uprights 20, 22 may be bent or curved to a desired shape.

FIG. 2 also shows that various adapters 36 can be positioned, for instance, along the channels 28 and 32 to anchor together the frame 12 and the console 18. In this example, the adapters 36 are L-shaped brackets, which are described in greater detail below with reference to FIG. 3. Also shown in this FIG. 2 example, the boat top 16 may be welded, screwed or otherwise attached to the uprights 20, 22 and provided with a first top arm or brace 64 for additional stability and weight bearing capacity. Like the frame 12, the frame 14 shown in FIG. 1 would be similarly adjusted and connected to surrounding equipment, which is described by way of further example with respect to FIG. 4 below.

Figure 3:
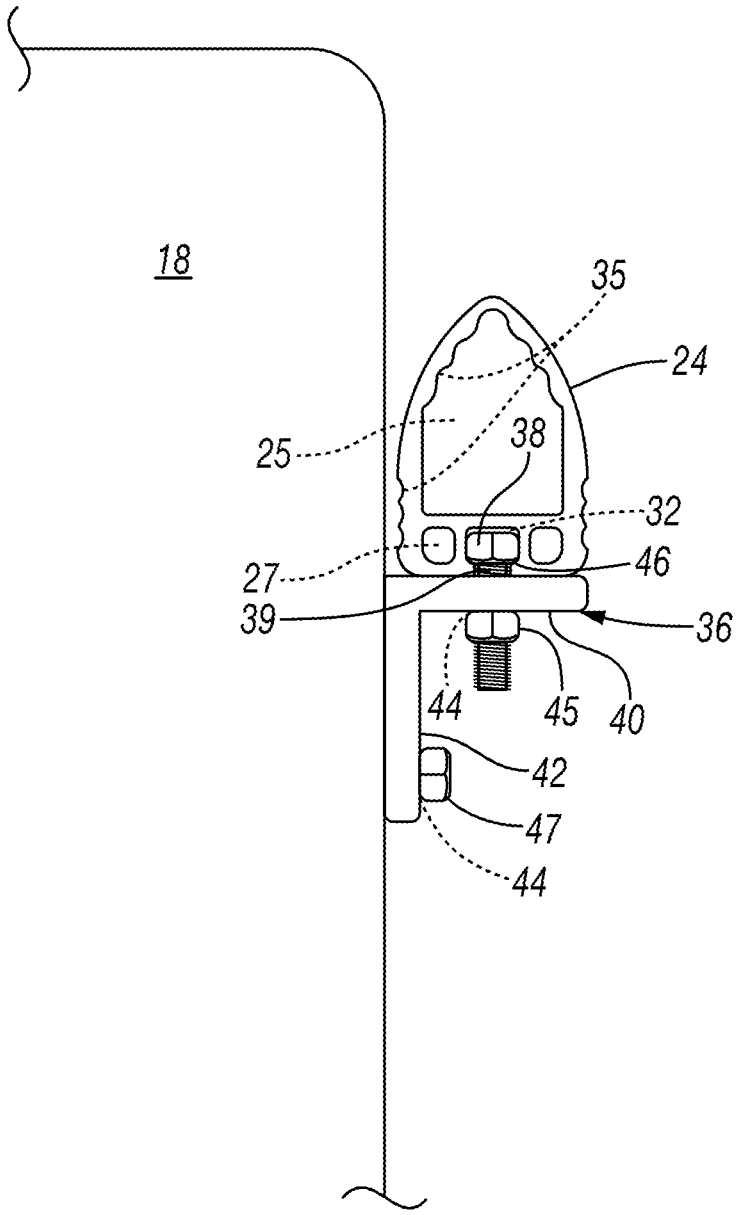
FIG. 3 is a partial, cutaway, elevational view of components taken along line III-III in FIG. 2.

FIG. 3 shows a cross-section of the crossbar 24 relative to its adapter 36. As briefly introduced above, this exemplary crossbar 24 may be extruded in a "D" shaped tube. The crossbar 24 may include internal and/or external scallops or indentations 35 that provide additional strength and structural integrity to resist deformation during production and also when under operational loads. As the cross-section shows, the crossbar 24 may be formed with a space or void 25 and cavities 27, which may extend the length of the crossbar 24. The void 25 and cavities 27 can serve to lower cost, save material and reduce weight, where lighter weights may be desirable, especially for smaller vessels.

FIG. 3 most clearly shows the first channel 32 in the crossbar 24 for receiving a connector such as a T-bolt 38. The connector 38 is free to slide along the channel 32 of the crossbar 24 until the connector 38 is tightened or rendered stationary by a mechanism such as a weld, a clip, a cotter key, or a nut 45 in a desired position along the crossbar 24 proximate the console 18. More particularly, a narrower or smaller rod or screw portion 39 of the connector 38 extends through a hole or aperture 44 in a first leg or shelf 40 of the adapter 36. Once the adapter 36 is positioned along the crossbar 24 in the desired position next to the console 18, the nut 45 can be tightened to prevent the head of the connector 38 from further travel in the channel 32 by urging a portion of the connector 38 against an aperture neck or shoulder 46 formed in the channel 32 of the crossbar 24 to lock the connector 38 in place. Also shown, a fastener 47 can be inserted through another aperture 44 in a second leg or shelf 42 of the adapter 36 to render the adapter 36 and the crossbar 24 stationary relative to the console 18. As will be explained in more detail below, because the steering control unit or console 18 may arrive from different manufacturers in assorted sizes, the adapter 36 need not be L-shaped as in this example; its shape, size and orientation can vary. For instance, the legs 40, 42 of the adapter 36 may not be orthogonal as shown and may extend at a different angle relative to each other, or one of the legs 40, 42 may be longer than the other, or an additional extender may be added to one of the legs 40, 42 as discussed below, to accommodate various stand-off distances between, e.g., the console 18 and the adapter 36.

Figure 4:
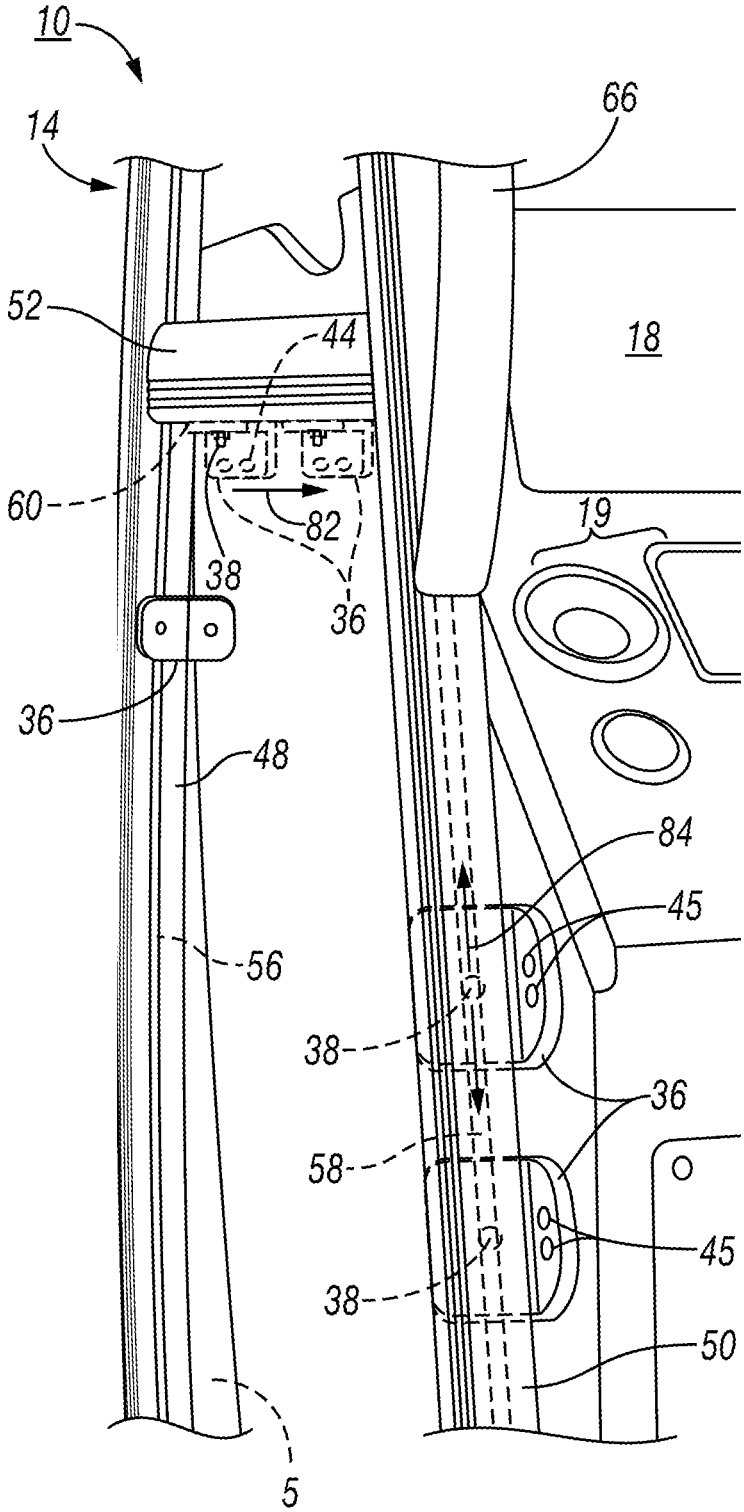
FIG. 4 is a partial, cutaway, perspective view of components as in FIG. 1 with certain components shown in phantom for clarity.

FIG. 4 shows a section of the left frame 14 that has been attached to areas of the console 18 in order to shield console equipment such as controls and gauges 19. As shown, the frame 14 may include a third or forward leg or upright 48 and a fourth or aft leg or upright 50. In this example, the uprights 48, 50 are spaced apart or separated from each other by an upper crossbar or beam 52 and a lower crossbar or beam 54 (see FIG. 5).

Figure 5:
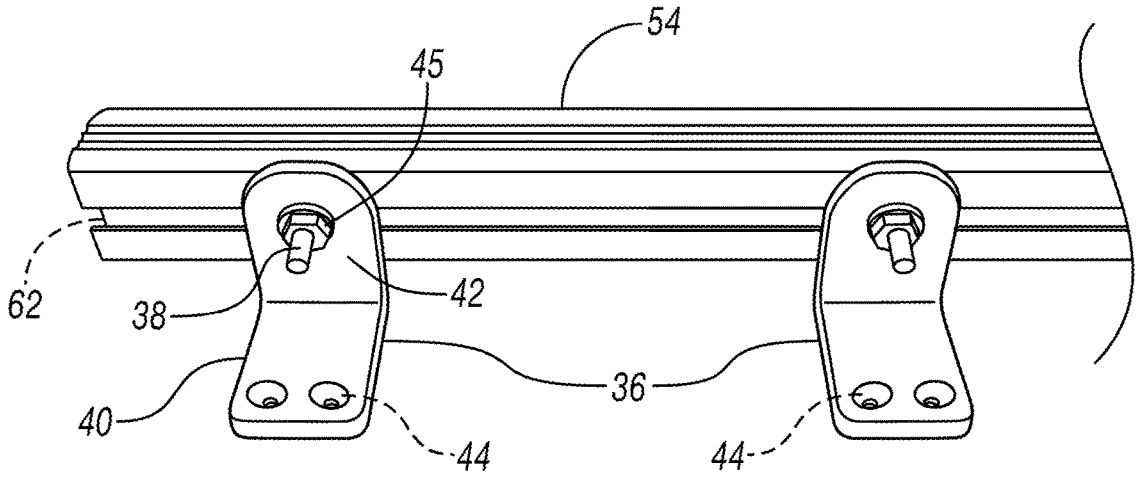
FIG. 5 is a partial, cutaway, perspective view of some components utilized in the embodiment shown in FIG. 1.

With reference now to both FIGS. 4 and 5, the uprights 48, 50 have respective raceways, channels, tracks, or grooves 56, 58 and the crossbars 52, 54 have respective raceways, channels, tracks, or grooves 60, 62. The raceways 56, 58, 60, 62 may extend most of or the entire length of their respective host components, or they may be formed in finite areas such as substantially flat or straight areas of the uprights 48, 50 and the crossbars 52, 54. Here, the adapter 36 on the upright 48 is attached to the console 18 above a gap 5 where the upright 48 and the console 18 diverge from each other due to the unique size and shape of this particular console 18. More particularly, the adapter 36 can be adjusted along the upright 48 until it is above the gap 5 where the upright 48 and the console 18 begin to converge or are closer together. At that point, the adapter 36 can be locked into the desired position as described above. Similarly, one or more adapters 36 can be adjusted along the raceway 60 of the crossbar 52 (see, e.g., direction arrow 82) and along the raceway 58 of the upright 50 (see, e.g., direction arrow 84). Again, once the adapters 36 are in desired positions, their respective connectors 38 can be tightened or locked to render them stationary relative to their respective raceways, and the adapters 36 can be connected to points on the console 18 using the mechanisms 45 attached via the apertures 44. The foregoing examples highlight the adaptability of the system 10 to accommodate equipment of assorted sizes. The system 10 can be used with various brands of boat consoles, for instance, without having to customize the frame 14 for each boat manufacturer.

Figure 6A:
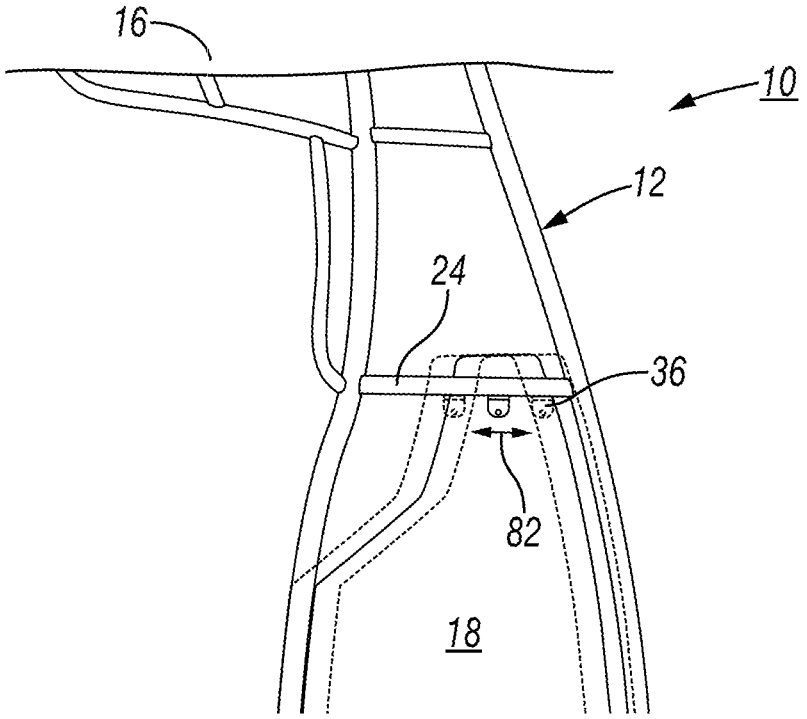
FIG. 6A is a partial, cutaway, elevational view of some components utilized in the embodiment shown in FIG. 1, particularly showing horizontal adjustment.

Turning to FIG. 6A, the adapter 36 is shown being adjusted substantially horizontally along the cross beam 24 per the direction arrow 82 to accommodate different sized consoles 18 and positions as introduced in FIG. 4.

Figure 6B:
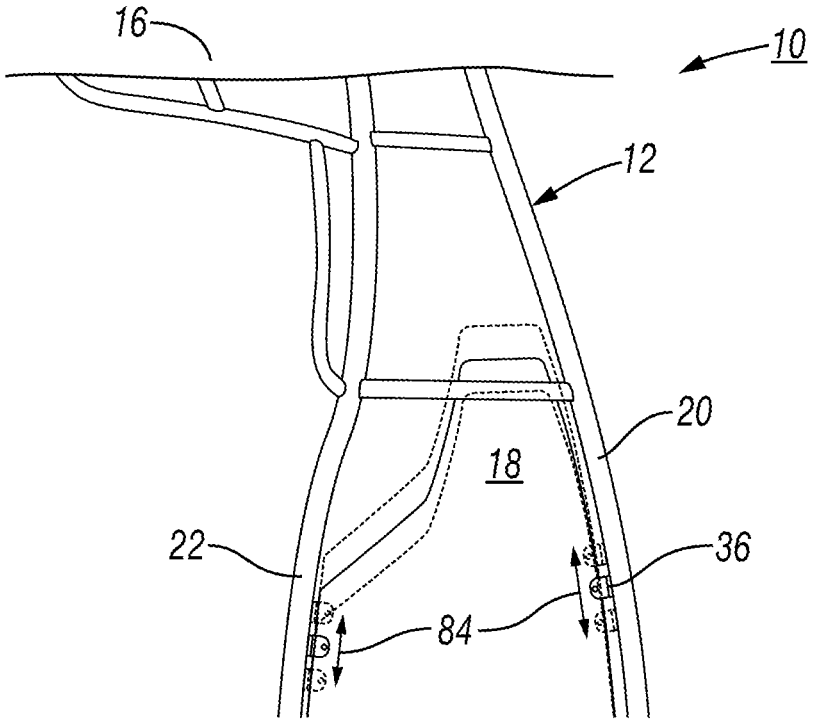
FIG. 6B is a partial, cutaway, elevational view of some components as in FIG. 6B, particularly showing vertical adjustment.

FIG. 6B shows various adapters 36 being adjusted substantially vertically along the uprights 20, 22 per the direction arrow 84 to accommodate consoles 18 or other equipment having different heights or sizes, also as introduced in FIG. 4.

Figure 7A:
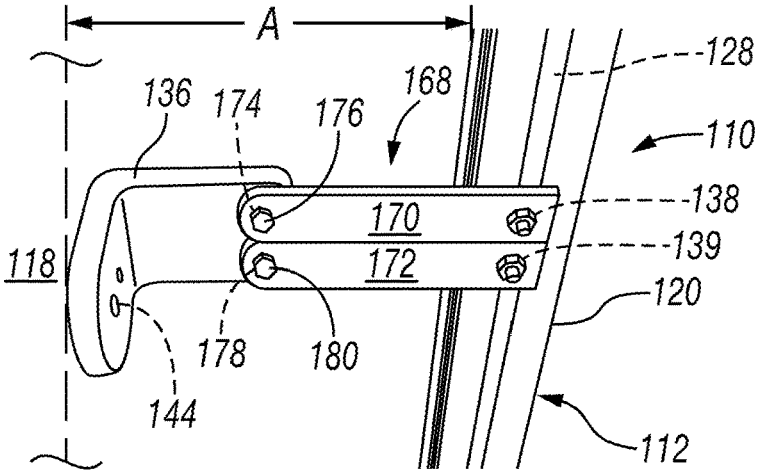
FIG. 7A is a partial perspective view of another embodiment shown in operation according to the disclosure.
Figure 7B:
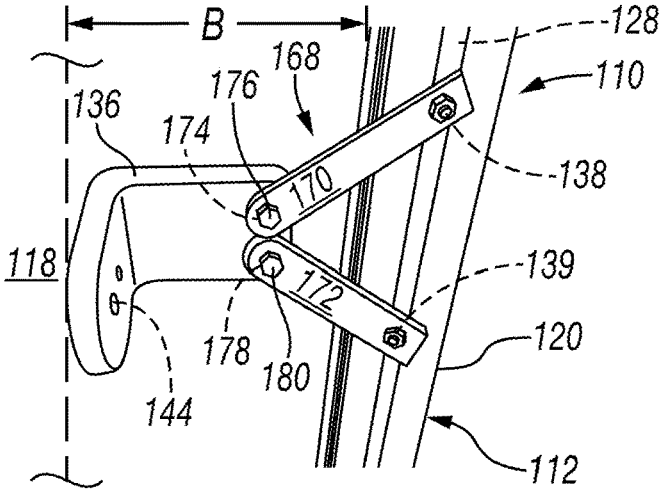
FIG. 7B is a partial perspective view of the embodiment as in FIG. 7A in a different state.
Figure 7C:
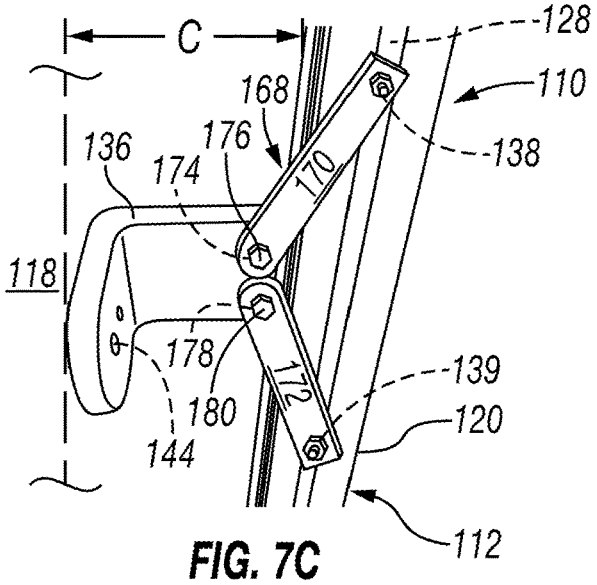
FIG. 7C is a partial perspective view of the embodiment as in FIG. 7A in a further state.

FIGS. 7A, 7B, and 7C show an alternative connector system 110 including an adapter 136 that can be positioned, respectively, at different standoff distances A, B and C. The adjustable adapter 136 can anchor together a frame 112 to boat equipment such as a center console 118 that may vary in size and shape according to different manufacturers. As shown, the adapter 136 may include a substantially L-shaped bracket but may also include hinges and be sized and shaped differently than this example.

More particularly, in the aspect shown in FIG. 7A, a distance or space to a portion of the console 118 (shown schematically in phantom for clarity) may be a stand-off distance indicated by the letter A. In this case, a scissor assembly 168 may be provided with an extension assembly or extender such as arms or bars 170, 172. Here, the arm 170 may be movably attached in a channel 128 of an upright 120 using a spinner, pivot device, or pin joint 138 such as a free-rotation or non-locking bolt, screw or rivet. An opposite end of the arm 170 may be movably attached through an aperture 174 in the adapter 136 using a rotatable or swiveling bolt, screw or pin joint rivet 176. Similarly, the arm 172 may be movably attached in the channel 128 using a pin joint 139 with an opposite end of the arm 172 movably attached through an aperture 178 in the adapter 136 using another pin joint bolt 180. Once the adapter 136 is positioned where desired along the console 118, a bolt, screw or rivet can be inserted through an aperture 144 of the adapter 136 into the console 118.

FIG. 7B shows that the space between a portion of the console 118 and the frame 112 may be at a stand-off distance indicated by the letter B. Again, the arms 170, 172 of the scissor assembly 168 may be movably attached in the channel 128 using respective pin joints 138, 139; i.e., the pin joints 138, 139 can be moved apart from each other thereby scissoring the arms 170, 172 apart to move the upright 112 closer to the console 118. As shown, the arms 170, 172 scissor or spread apart to accommodate the wider console 118. Once the adapter 136 is positioned where desired along the console 118, bolts, screws or rivets can be inserted through the aperture 144 of the adapter 136 into the console 118 to render the console 118 stationary relative to the frame 112.

Still further, FIG. 7C shows that the space from the frame 112 to a portion of the console 118 may be smaller or narrower or at a shorter stand-off as indicated by gap C. As above, once the adapter 136 is positioned where desired along the console 118, the scissor nuts 170, 180 of the assembly 168 can be secured, and the adapter 136 can be connected to the console 118.

Figure 8:
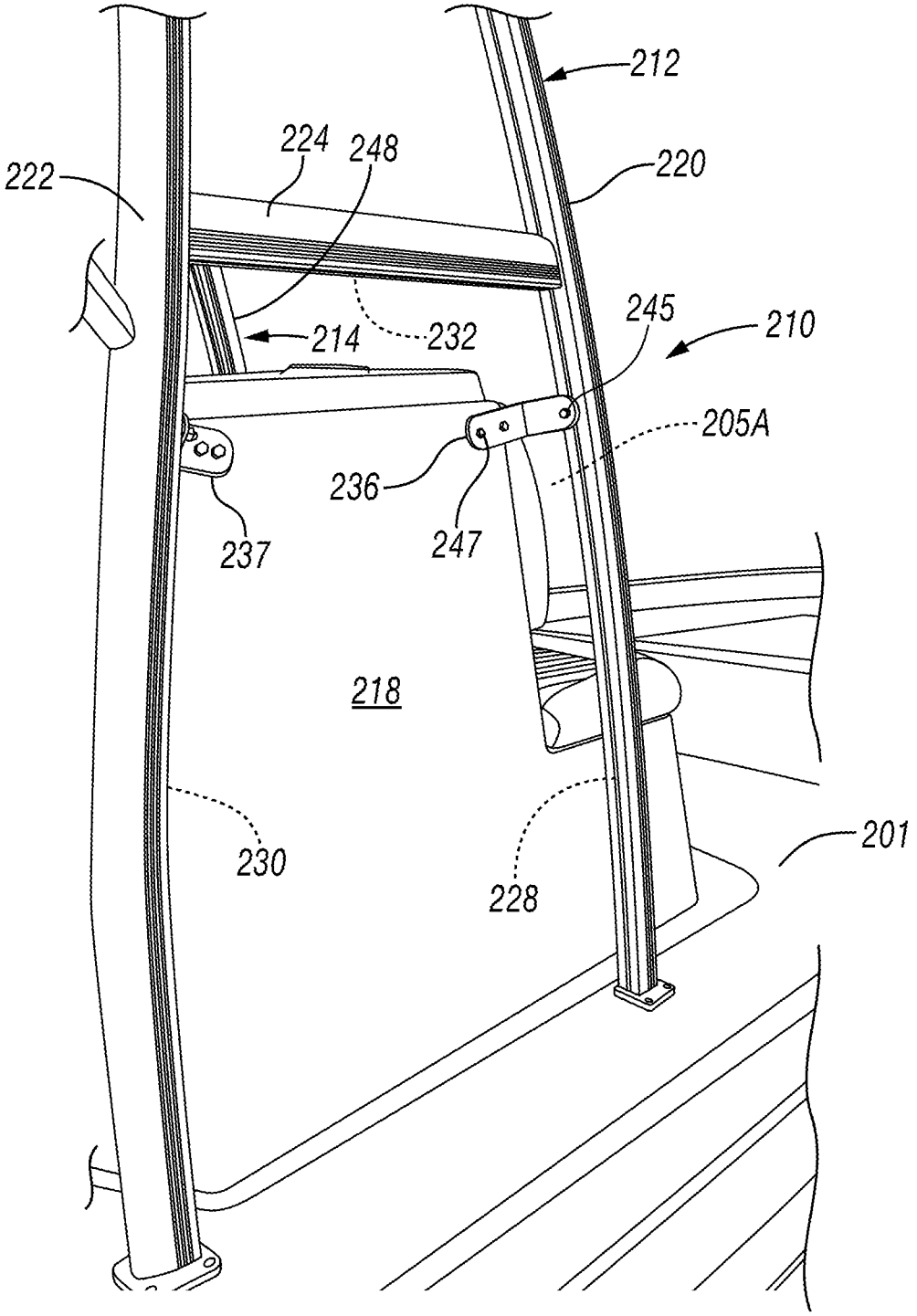
FIG. 8 is a partial perspective view of another aspect of the disclosure.
Figure 9:
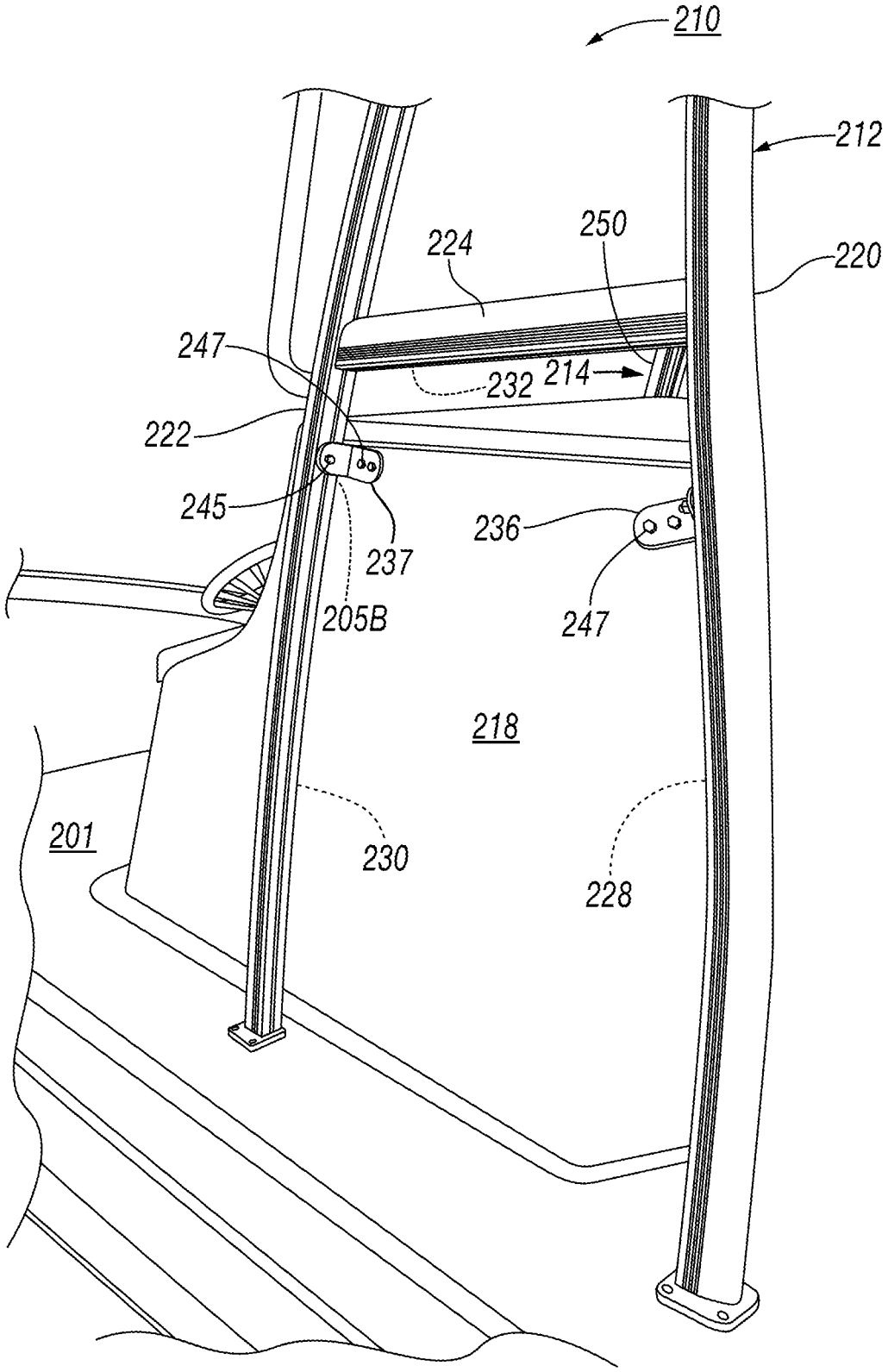
FIG. 9 is another partial perspective view as in FIG. 8.

Turning to FIGS. 8 and 9, a right frame 212 and a left frame 214 of a vessel scaffold system 210 are partially shown in connection with a wheelhouse console 218 on a marine vessel 201. The right frame 212 may include a forward or first leg or upright 220 and an aft or second leg or upright 222, and the left frame 214 may include a forward or third leg or upright 248 and an aft or fourth leg or upright 250.

The right frame 212 is most clearly shown in FIGS. 8 and 9 with its partially shown uprights 220, 222 spaced apart or separated from each other by a crossbar or beam 224. Here, the uprights 220, 222 have respective raceways, tracks, channels, or grooves 228, 230. Although the channels 228, 230 are shown in this exemplary embodiment running most or all the length of their respective uprights 220, 222, the channels 228, 230 may be formed only in substantially flat areas of the exemplary uprights 220, 222. Likewise, a raceway 232 may be formed in the crossbar 224 for adjustably attaching a portion of the crossbar 224 to equipment positioned within or near the uprights 220, 222. Together, the uprights 220, 222 and the crossbar 224, for instance, form a triangle of stability, which is adjustably attached to nearby equipment for elevating a boat top.

In the example shown in FIGS. 8 and 9, the uprights 220, 222, the crossbar 224 and other portions of the system 210 can be made from 6063-type "D" shaped extruded aluminum, which provides suitable structural strength for bending with the channels 228, 230 therein. As shown most clearly in FIG. 8, the curvilinear forward upright 220 may be spaced apart from the console 218 by an irregular gap, distance or space 205A. Accordingly, a relatively larger bracket or adapter 236 may be required to bridge the gap 205A whereby the adapter 236 is movably attached at one end by a fastener or anchor 245 in the channel 228 and affixed at another end of the adapter 236 to the console 218 with one or more fasteners 247.

FIG. 9 most clearly shows that the curvilinear rear upright 222 may be spaced apart from the console 218 by a smaller gap, distance or space 205B relative to the space 205A. shown in FIG. 8. Accordingly, a relatively smaller bracket or adapter 237 may be used to bridge the gap 205B. Here, the adapter 237 is movably attached at one end by a fastener or anchor 245 in the channel 230 and affixed at another end of the adapter 237 to the console 218 with one or more fasteners 247.

Figure 10:
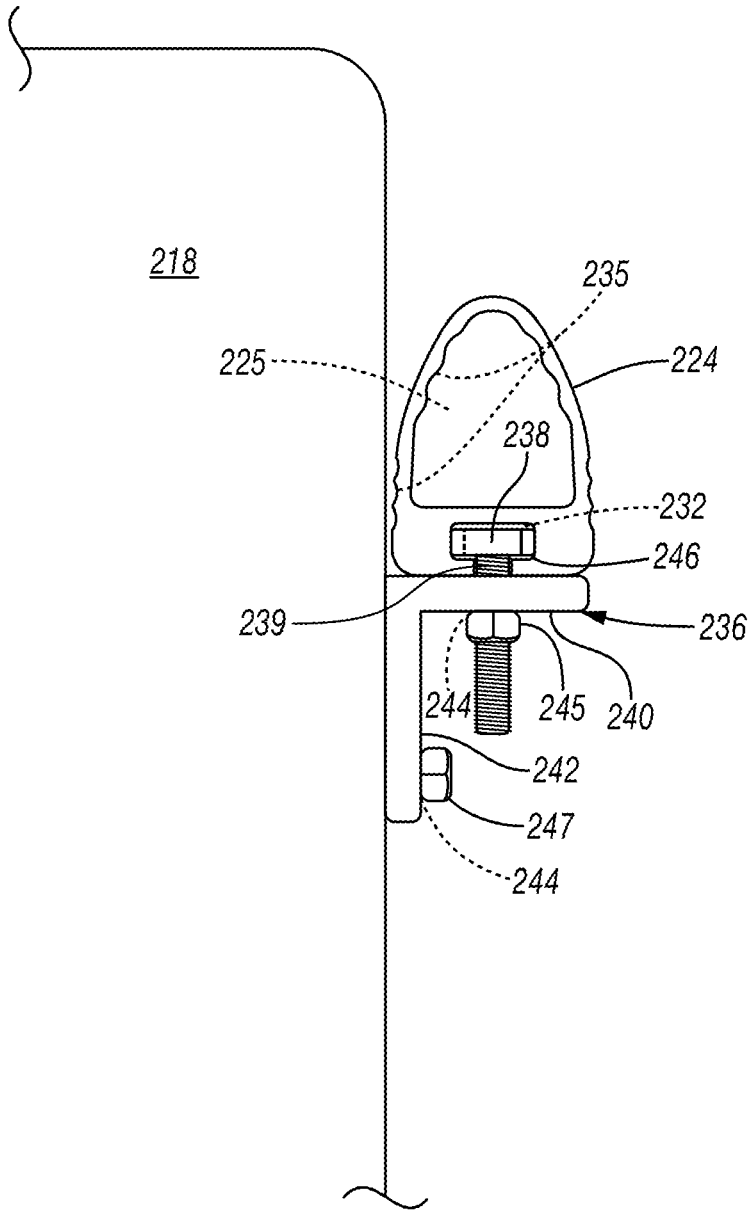
FIG. 10 is a partial, cutaway, elevational view of some components as in FIG. 9.

With reference to FIG. 10, a cross-section of the crossbar 224 as in FIG. 9 shows a variation of the embodiment of FIG. 3. As briefly introduced above, this exemplary crossbar 224 is extruded in a "D" shaped tube. The crossbar 224 may include internal and/or external scallops or indentations 235 that provide additional strength and structural integrity to resist deformation during production and when under operational loads. As the cross-section shows, the crossbar 224 may be formed with a space or void 225 but without the extruded cavities 27 shown in the exemplary embodiment of FIG. 3. Here, the void 225 can serve to reduce cost and save material and weight where lighter weights may be desirable, especially for smaller vessels.

FIG. 10 most clearly shows the first channel 232 in the crossbar 224 for receiving a connector such as a connector 238. The exemplary connector 238 may include a three-eighths inch (⅜") wide head, which is free to slide along the channel 232 of the crossbar 224 until the connector 238 is tightened or rendered stationary by a mechanism such as a weld, a clip, a cotter key, or a nut 245 in a desired position along the crossbar 224 proximate the console 218. The embodiment is not limited to a ⅜" head. Also shown, a narrower or smaller rod or screw portion 239 of the connector 238 extends through a hole or aperture 234 in a first leg or shelf 240 of the adapter 236. Once the adapter 236 is positioned along the crossbar 224 in the desired position next to the console 218, the nut 245 can be tightened to prevent the relatively large head of the connector 238 from further travel in the channel 232 by pressing a portion of the larger connector 238 against an aperture neck or shoulder 246 formed in the crossbar 324. The relatively large head of the connector 238 provides additional stability and securement. Further, a fastener 247 can be inserted through another aperture 244 in a second leg or shelf 242 of the adapter 236 to render the adapter 236 and the thus the crossbar 224 stationary relative to the console 218.

Figure 11A:
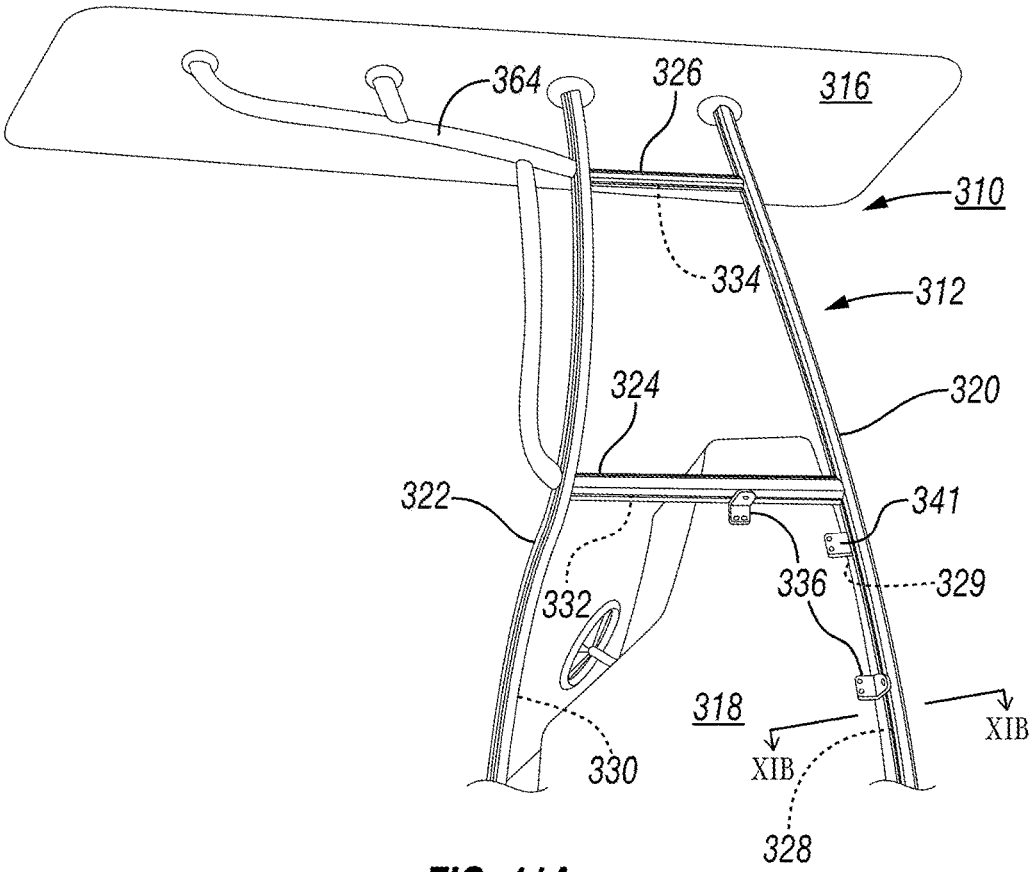
FIG. 11A is a partial perspective view of a further aspect of the disclosure.

Turning to FIG. 11A, a right frame 312 of a universal boat top system 310 is most clearly shown in connection with a center console 318 (a complementary or mirror image left frame (not shown) would also be connected to the console 318). As shown, the right frame 312 may include a forward or first leg or upright 320 and an aft or second leg or upright 322. In this example, the uprights 320, 322 are spaced apart or separated from each other by a lower or bottom crossbar or beam 324 and an upper or top crossbar or beam 326. Here, the uprights 320, 322 have respective raceways, tracks, channels, or grooves 328, 330, and the crossbars 324, 326 have respective raceways, tracks, channels or grooves 332, 334 for adjusting adapter or connectors 336 for attachment to the console 318.

Figure 11B:
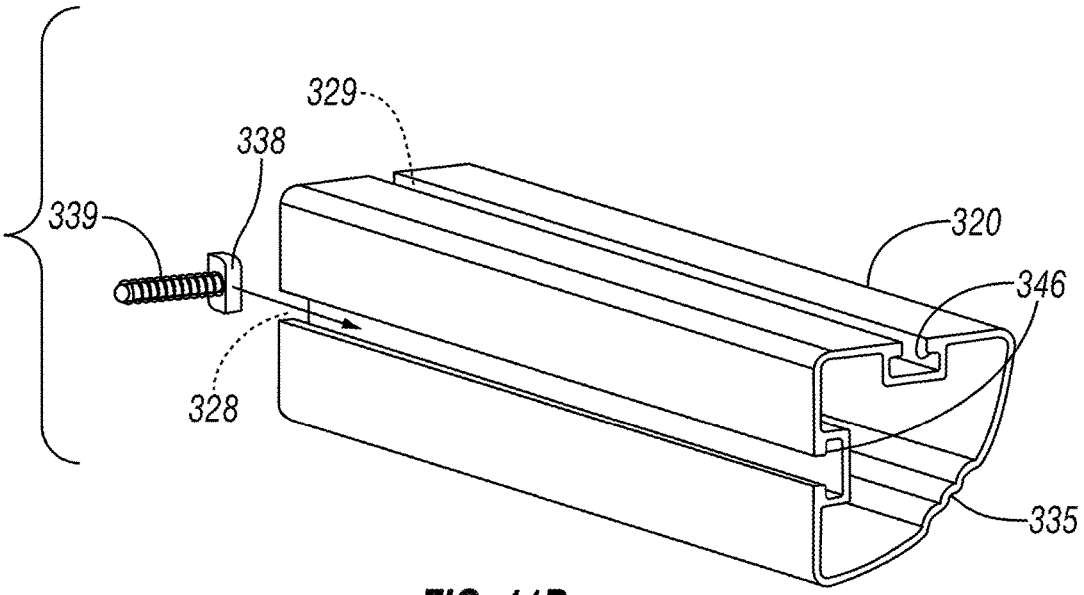
FIG. 11B is an exploded, partial cutaway view of some components as in FIG. 11A taken along line XIB-XIB.

Moreover, as FIG. 11B most clearly shows, the uprights, such as upright 320, may have an additional raceway, track, channel, or groove 329 in which another adapter or connector 341 can be adjustably positioned and locked for further attachment to the console 318 or other nearby equipment to further secure the system 310. Here, the slots 328, 329 each extend along the upright 320 and have shoulders 346 for holding a T-bolt head 338, for instance, in the channels 328, 329 while a rod or screw extension 339 depends from the head 338 to receive an adapter 336 or 341. Those skilled in the art will appreciate that, in addition to utilizing the slots 328, 329 to help attach the system 310 to the console 318, other devices and equipment such as a gull-wing windshield (not shown) can be attached via the raceway 329 to provide additional protection to the console 318 and to persons standing in its proximity.

With further reference to FIG. 11A, various adapters 336 can be positioned, for instance, along the channels 328 and 332 in this example to anchor together the frame 312 and the console 318. Here, the adapters 336 are L-shaped brackets, but may be different shapes and sizes to accommodate different sized equipment such as various brands of center consoles 318. Also in this example, a boat top 316 is attached to the uprights 320, 322 and provided with a first top arm or brace 364 for additional stability and weight bearing capacity.

EXEMPLARY EMBODIMENTS

Embodiment 1

A tower adjustment system for boats, comprising an upright for holding a boat top, the upright having a first raceway formed therein; a cross bar connected to the upright, the cross bar having a second raceway formed therein; and an adapter movable along at least one of the first and second raceways, the adapter being attachable to a control console and securable in the raceway to render the upright stationary relative to the console.

Embodiment 2

The tower adjustment system for boats of embodiment 1, wherein the cross bar is D-shaped in cross-section.

Embodiment 3

The tower adjustment system for boats of any one of embodiments 1-2, wherein the cross bar is made from extruded aluminum.

Embodiment 4

The tower adjustment system for boats of any one of embodiments 1-3, wherein the adapter is L-shaped.

Embodiment 5

The tower adjustment system for boats of one of the foregoing embodiments, further comprising a connector having a head slidable in the raceways and connected to the adapter.

Embodiment 6

The tower adjustment system for boats of one of the foregoing embodiments, further comprising an extension assembly movably connected to the adapter, the extension assembly being configured to bridge a gap between the control console and the upright.

Embodiment 7

The tower adjustment system for boats of one of the foregoing embodiments, further comprising at least two adapters.

Embodiment 8

The tower adjustment system for boats of one of the foregoing embodiments, further comprising at least two uprights disposed apart from each other and substantially parallel to each other for holding the boat top.

Embodiment 9

The tower adjustment system for boats of one of the foregoing embodiments, wherein the upright or the cross bar includes a third raceway formed therein for receiving an additional adapter for connecting to boat equipment proximate the upright or the cross bar.

Embodiment 10

The tower adjustment system for boats of any one of embodiments 1-8, wherein the upright or the cross bar includes a third raceway formed therein for receiving equipment.

Embodiment 11

A tower adjustment system for boats, comprising at least two uprights disposed in parallel and apart from each other for holding a boat top, each upright having a substantially vertically oriented raceway formed therein; a respective cross bar connected to each of the uprights, the cross bars each having a substantially horizontally oriented raceway formed therein; and a plurality of adapters movable along the raceways, the adapters being attachable to a plurality of boat equipment proximate the uprights and securable in the raceways to render the uprights stationary relative to the boat equipment.

Embodiment 12

The tower adjustment system for boats of embodiment 11, wherein the cross bar is D-shaped in cross-section.

Embodiment 13

The tower adjustment system for boats as any one of embodiments 11-12, wherein the cross bar has scallop shaped indentations.

Embodiment 14

The tower adjustment system for boats as any one of embodiments 11-13, wherein the cross bar is made from extruded aluminum.

Embodiment 15

The tower adjustment system for boats as any one of embodiments 11-14, wherein the adapter is L-shaped.

Embodiment 16

The tower adjustment system for boats as any one of embodiments 11-15, further comprising a connector having a head slidable within the raceways and a body depending from the head connectable to the adapter.

Embodiment 17

The tower adjustment system for boats as any one of embodiments 11-16, further comprising an extension assembly movably connected to the adapter, the extension assembly being configured to bridge a gap between one of the boat equipment and the upright.

Embodiment 18

The tower adjustment system for boats as any one of embodiments 11-17, wherein one of the boat equipment is a console.

Embodiment 19

The tower adjustment system for boats as any one of embodiments 11-18, wherein at least one of the uprights or the cross bar has at least two raceways formed therein for receiving an additional adapter for connection to the boat equipment.

Embodiment 20

The tower adjustment system for boats as any one of embodiments 11-18, wherein at least one of the uprights or the cross bar has a second raceway disposed apart from the first raceway for receiving equipment.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

That which is claimed is:

1. A tower adjustment system for boats, comprising:

an upright for holding a boat top, the upright having a first raceway formed therein;

a cross bar connected to the upright, the cross bar having a second raceway formed therein;

an adapter movable along at least one of the first and second raceways, the adapter being attachable to a control console and securable in the raceway to render the upright stationary relative to the console; and an extension assembly movably connected to the adapter, the extension assembly being configured to bridge a gap between the control console and an upright.

2. The tower adjustment system for boats as in claim 1, wherein the cross bar is D-shaped in cross-section.

3. The tower adjustment system for boats as in claim 1, wherein the cross bar is made from extruded aluminum.

4. The tower adjustment system for boats as in claim 1, wherein the adapter is L-shaped.

5. The tower adjustment system for boats as in claim 1, further comprising a connector having a head slidable in the raceways and connected to the adapter.

6. The tower adjustment system for boats as in claim 1, further comprising at least two adapters.

7. The tower adjustment system for boats as in claim 1, further comprising at least two uprights disposed apart from each other and substantially parallel to each other for holding the boat top.

8. The tower adjustment system for boats as in claim 1, wherein the upright or the cross bar includes a third raceway formed therein for receiving an additional adapter for connecting to boat equipment proximate the upright or the cross bar.

9. The tower adjustment system for boats as in claim 1, wherein the upright or the cross bar includes a third raceway formed therein for receiving equipment.

10. A tower adjustment system for boats, comprising:

at least two uprights disposed in parallel and apart from each other for holding a boat top, each upright having a substantially vertically oriented raceway formed therein;

a respective cross bar connected to each of the uprights, the cross bars each having a substantially horizontally oriented raceway formed therein;

a plurality of adapters movable along the raceways, the adapters being attachable to a plurality of boat equipment proximate the uprights and securable in the raceways to render the uprights stationary relative to the boat equipment; and an extension assembly movably connected to the adapter, the extension assembly being configured to bridge a gap between one of the boat equipment and the upright.

11. The tower adjustment system for boats as in claim 10, wherein the cross bar is D-shaped in cross-section.

12. The tower adjustment system for boats as in claim 10, wherein the cross bar has scallop shaped indentations.

13. The tower adjustment system for boats as in claim 10, wherein the cross bar is made from extruded aluminum.

14. The tower adjustment system for boats as in claim 10, wherein the adapter is L-shaped.

15. The tower adjustment system for boats as in claim 10, further comprising a connector having a head slidable within the raceways and a body depending from the head connectable to the adapter.

16. The tower adjustment system for boats as in claim 10, wherein one of the boat equipment is a console.

17. The tower adjustment system for boats as in claim 10, wherein at least one of the uprights or the cross bar has at least two raceways formed therein for receiving an additional adapter for connection to the boat equipment.

18. The tower adjustment system for boats as in claim 10, wherein at least one of the uprights or the cross bar has a second raceway disposed apart from the first raceway for receiving equipment.

* * * * *